US008810612B2

(12) United States Patent
Lee et al.

(10) Patent No.: US 8,810,612 B2
(45) Date of Patent: Aug. 19, 2014

(54) DISPLAY DEVICE AND MEMORY ARRANGING METHOD FOR IMAGE DATA THEREOF

(75) Inventors: An-Su Lee, Yongin (KR); Byung-Geun Jun, Yongin (KR); Do-Youb Kim, Yongin (KR); Seung-Woo Lee, Yongin (KR); Myung-Ho Lee, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 203 days.

(21) Appl. No.: 13/557,032

(22) Filed: Jul. 24, 2012

(65) Prior Publication Data

US 2013/0208019 A1 Aug. 15, 2013

(30) Foreign Application Priority Data

Feb. 10, 2012 (KR) ..... 10-2012-0013897

(51) Int. Cl.
*G09G 5/10* (2006.01)

(52) U.S. Cl.
USPC ..... 345/690

(58) Field of Classification Search
None
See application file for complete search history.

(56) References Cited

U.S. PATENT DOCUMENTS 7,808,467 B2 * 10/2010 Kawata ..... 345/89
2003/0179221 A1 * 9/2003 Nitta et al. ..... 345/690

FOREIGN PATENT DOCUMENTS

JP 2006-084860 A 3/2006
JP 2011-007889 A 1/2011
KR 10-2006-0017201 A 2/2006
KR 10-2006-0065084 A 6/2006

* cited by examiner

*Primary Examiner* — Adam R Giesy
(74) *Attorney, Agent, or Firm* — Knobbe, Martens, Olson & Bear, LLP

(57) ABSTRACT

A display device and an image data memory arrangement method thereof are disclosed. When driving one frame with first and second fields, an input data signal is divided into first and second field data and the first and second field data are respectively arranged according to a light emitting driving sequence to control the light emitting for each field to be displayed. The first and second field data signals respectively include a color data signal pattern in which the data signals transmitted to the pixels corresponding to the same pixel column among the pixels respectively included in the first pixel row and the fourth pixel row display the same color, and the data signals transmitted to the pixels corresponding to the same pixel column among the pixels respectively included in the second pixel row and the third pixel row display the same color.

26 Claims, 17 Drawing Sheets

FIG. 10

| | | | | | |
|---|---|---|---|---|---|
| Line 1 | R(1,1)<br>G(1,1)<br>B(1,1) | R(1,2)<br>G(1,2)<br>B(1,2) | R(1,3)<br>G(1,3)<br>B(1,3) | R(1,4)<br>G(1,4)<br>B(1,4) | · · · |
| Line 2 | R(2,1)<br>G(2,1)<br>B(2,1) | R(2,2)<br>G(2,2)<br>B(2,2) | R(2,3)<br>G(2,3)<br>B(2,3) | R(2,4)<br>G(2,4)<br>B(2,4) | · · · |
| Line 3 | R(3,1)<br>G(3,1)<br>B(3,1) | R(3,2)<br>G(3,2)<br>B(3,2) | R(3,3)<br>G(3,3)<br>B(3,3) | R(3,4)<br>G(3,4)<br>B(3,4) | · · · |
| Line 4 | R(4,1)<br>G(4,1)<br>B(4,1) | R(4,2)<br>G(4,2)<br>B(4,2) | R(4,3)<br>G(4,3)<br>B(4,3) | R(4,4)<br>G(4,4)<br>B(4,4) | · · · |
| ⋮ | ⋮ | ⋮ | ⋮ | ⋮ | ⋮ |

FIG. 11

1SF

| | | | | | | |
|---|---|---|---|---|---|---|
| L1 | R(1,1) | B(1,1) | G(1,2) | R(1,3) | B(1,3) | G(1,4) |
| L2 | G(2,1) | R(2,2) | B(2,2) | G(2,3) | R(2,4) | B(2,4) |
| L3 | G(3,1) | R(3,2) | B(3,2) | G(3,3) | R(3,4) | B(3,4) |
| L4 | R(4,1) | B(4,1) | G(4,2) | R(4,3) | B(4,3) | G(4,4) |

2SF

| | | | | | | |
|---|---|---|---|---|---|---|
| L1 | G(1,1) | R(1,2) | B(1,2) | G(1,3) | R(1,4) | B(1,4) |
| L2 | R(2,1) | B(2,1) | G(2,2) | R(2,3) | B(2,3) | G(2,4) |
| L3 | R(3,1) | B(3,1) | G(3,2) | R(3,3) | B(3,3) | G(3,4) |
| L4 | G(4,1) | R(4,2) | B(4,2) | G(4,3) | R(4,4) | B(4,4) |

DISPLAY DEVICE AND MEMORY ARRANGING METHOD FOR IMAGE DATA THEREOF

CROSS-REFERENCE TO RELATED APPLICATION

This application claims priority to and the benefit of Korean Patent Application No. 10-2012-0013897 filed in the Korean Intellectual Property Office on Feb. 10, 2012, the entire contents of which are incorporated herein by reference.

BACKGROUND (a) Field

The described technology generally relates to a display device and a method for arranging an image data memory thereof.

(b) Description of the Related Technology

A plurality of scan lines extending in a row direction (e.g., a horizontal direction) and a plurality of data lines extending in a column direction (e.g., a vertical direction) are formed in a display area of an active matrix display device such as a liquid crystal display (LCD) or an organic light emitting diode (OLED) display. A pixel area is defined by a cross region of a corresponding scan line among a plurality of scan lines and a corresponding data line among a plurality of data lines, and a pixel is formed in a matrix shape in the pixel area. Also, one pixel includes an active element, that is, a transistor, that transmits a data signal from the data line in response to a scan signal transmitted from the scan line. Accordingly, the display device includes a scan driver to drive the scan line and a data driver to drive the data line.

Also, in this display device, in general, a brightness combination of an R pixel representing red light (hereinafter referred to as "R"), a G pixel representing green light (hereinafter referred to as "G"), and a B pixel representing blue light (hereinafter referred to as "B") displays various colors. Accordingly, in the display device, the R, G, and B pixels are continuously disposed in a row direction, and are respectively connected to the data lines.

SUMMARY

One inventive aspect is a method of arranging a memory data for reducing color division in time-division driving, and a display device using the same.

Another aspect is a memory arrangement method for image data for classifying the image data stored to a memory of a display device into a type that is suitable for a light emitting driving method and effectively managing the memory.

Also, in the time-division driving method, an arrangement method of the memory data to solve a color division phenomenon that may be generated when performing a 1 dot pattern inspection is provided.

Another aspect is a display device classifying the image data into the type that is suitable for the light emitting driving method, effectively managing the memory, and reducing and removing the color division phenomenon upon the performing of the 1 dot pattern inspection to realize image quality with high efficiency.

Another aspect is a display device which includes: a display unit including a plurality of pixels including a first light emitting element emitting light in a first field and a second light emitting element emitting light in a second field; and a data driver extracting an input data signal that is divided into the first field and the second field and arranged according to the light emitting driving sequence and transmitting a first field data signal and a second field data signal to a corresponding data line.

The first field data signal and the second field data signal respectively include a color data signal pattern in which the data signal transmitted to the pixels included in the first pixel row and the fourth pixel row and corresponding to the same pixel column displays the same color, and the data signal transmitted to the pixels included in the second pixel row and the third pixel row and corresponding to the same pixel column displays the same color, among the pixels included in a first region defined by four continuous pixel rows and three continuous pixel columns.

For the color data signal pattern, the data signals are arranged to be repeated in the first field data signal and the second field data signal.

The display device may further include a scan driver sequentially supplying a corresponding scan signal to a plurality of scan lines connected to a plurality of pixels according to the pixel row to activate the driving of each pixel.

Among the pixels included in the first region, two light emitting elements included in the pixels corresponding to the same pixel column may emit light of the same color.

Among the pixels included in the first region, an arrangement sequence of the color emitted by two light emitting elements included in the pixels corresponding to the same pixel row may be a sequence of a first color, a second color, and a third color, however it is not limited thereto. The first color, the second color, and the third color may be red, green, and blue.

For the color data signal pattern corresponding to the pixels included in the first region, the first field data signal and the second field data signal may be crossed with different colors from each other.

The first field data signal may include a first color data signal, a third color data signal, and a second color data signal sequentially applied to three pixels included in the first pixel row and the fourth pixel row of the first region, and a second color data signal, a first color data signal, and a third color data signal sequentially applied to three pixels included in the second pixel row and the third pixel row of the first region.

The second field data signal may include a second color data signal, a first color data signal, and a third color data signal sequentially applied to three pixels included in the first pixel row and the fourth pixel row of the first region, and the first color data signal, the third color data signal, and the second color data signal sequentially applied to three pixels included in the second pixel row and the third pixel row of the first region.

The display unit may include a first light emitting transistor controlling the light emitting of one element and a second light emitting transistor controlling the light emitting of the other element, as at least two light emitting elements including one element and the other element of a plurality of pixels. The display unit may have a first wire connection shape such that the first light emission control line is connected to the gate electrode of each first light emitting transistor of a plurality of pixels included in the first pixel row and the second light emission control line is connected to the gate electrode of the second light emitting transistor, a second wire connection shape such that the second light emission control line is connected to the gate electrode of each first light emitting transistor of a plurality of pixels included in the second pixel row and the first light emission control line is connected to the gate electrode of the second light emitting transistor, the second wire connection shape of a plurality of pixels included in the third pixel row, and the first wire connection shape of a plurality of pixels included in the fourth pixel row.

In the display unit, the wire connection shape included in the first pixel row to the fourth pixel row may be repeated by four pixel row units.

In the first field of one frame in response to the first light emission control signal transmitted through the first light emission control line, a plurality of pixels included in the first pixel row and the fourth pixel row may respectively emit the light through one element, and a plurality of pixels included in the second pixel row and the third pixel row may emit the light through the other element.

In the second field of one frame in response to the second light emission control signal transmitted through the second light emission control line, a plurality of pixels included in the first pixel row and the fourth pixel row may respectively emit the light through the other element, and a plurality of pixels included in the second pixel row and the third pixel row may emit the light through one element.

The display device may further include a light emission driver sequentially supplying a first light emission control signal controlling the light emitting of the first light emitting element in the first field included in one frame and a second light emission control signal controlling the light emitting of the second light emitting element in the second field included one frame to a plurality of the first light emission control lines and a plurality of the second light emission control lines connected to a plurality of pixels according to the pixel row.

The first light emission control signal and the second light emission control signal may have opposite voltage phases to each other, and the voltage phase of the first light emission control signal and the second light emission control signal the first field and the second field may be inverted.

When the input data signal is a 1×1 dot pattern signal crossing and displaying a white image and a black image in up/down and right/left directions, color distribution ratios of the image displayed by the first field data signal and the image displayed by the second field data signal may be equal to each other.

The color distribution ratio may be a distribution ratio of the color data signal of the highest luminance in the first field and the second field, and it is not limited thereto. The color data signal of the highest luminance may be a green data signal.

Another aspect is a method arranging an image data memory of a display device which includes a plurality of pixels having at least two light emitting elements emitting light of different colors, driven with a first field and a second field for one frame, extracting an input data signal during one frame to apply to a data line, and controlling the light emitting of at least two light emitting elements for each field to be displayed.

In detail, the method includes dividing the input data signal into the first field data and the second field data, and arranging and storing the first and second field data according to a light emitting driving sequence.

The arranged first and second field data may respectively include a color data signal pattern in which the data signal transmitted to the pixels included in the first pixel row and the fourth pixel row and corresponding to the same pixel column displays the same color, and the data signal transmitted to the pixels included in the second pixel row and the third pixel row and corresponding to the same pixel column displays the same color, among the pixels included in a first region defined by four continuous pixel rows and three continuous pixel columns.

The arranged first and second field data may respectively repeat and include the color data signal pattern.

Among the pixels included in the first region, an arrangement sequence of the color emitted by two light emitting elements included in the pixels corresponding to the same pixel row may be a sequence of a first color, a second color, and a third color.

For the color data signal pattern corresponding to the pixels included in the first region, the first field data signal and the second field data signal may be crossed with different colors from each other.

The first field data may include a first color data signal, a third color data signal, and a second color data signal sequentially applied to three pixels included in the first pixel row and the fourth pixel row of the first region, and a second color data signal, a first color data signal, and a third color data signal sequentially applied to three pixels included in the second pixel row and the third pixel row of the first region.

The second field data may include a second color data signal, a first color data signal, and a third color data signal sequentially applied to three pixels included in the first pixel row and the fourth pixel row of the first region, and the first color data signal, the third color data signal, and the second color data signal sequentially applied to three pixels included in the second pixel row and the third pixel row of the first region.

The first color may be red, the second color may be green, and the third color may be blue.

When the input data signal is a 1×1 dot pattern signal crossing and displaying a white image and a black image in up/down and right/left directions, a color distribution ratio of the image displayed by the first field data signal and the second field data signal may be equal to each other. The color data signal of the highest luminance may be a green data signal.

BRIEF DESCRIPTION OF THE DRAWINGS

FIG. 10 is a view of an input data map of a display device according to an embodiment.

FIG. 11 is an input data map for a field by a memory management method of image data according to an embodiment.

DETAILED DESCRIPTION

Figure 1:
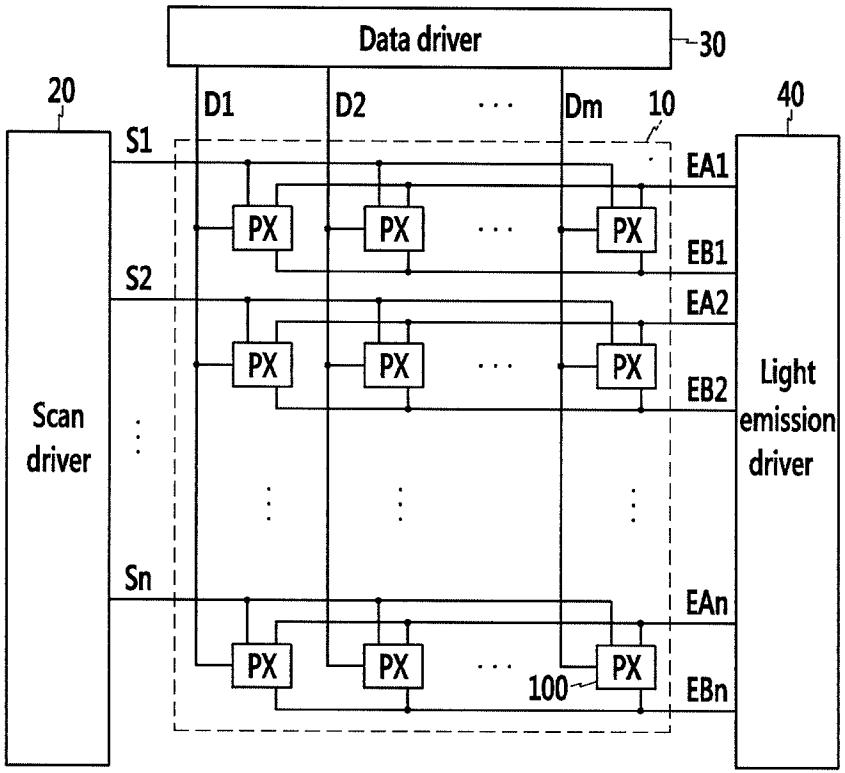
FIG. 1 is a schematic block diagram of a display device according to an embodiment.

A data driver for a display device generally converts a digital data signal into an analog signal to apply it to all data lines such that the data driver has output terminals corresponding to a number of the data lines. The data driver is typically formed of a plurality of integrated circuits, and the number of output terminals included in one integrated circuit is limited such that many integrated circuits are used to drive all data lines. Also, since a plurality of transistors, capacitors, and wires formed in one pixel and applying the voltages or the signals are used, it is difficult to dispose them inside the pixel. Further, in the limited display area, when respectively forming the data lines and the driving elements to drive the pixel for the R, G, and B pixels, the aperture ratio of the pixel is decreased.

Accordingly, it is generally necessary to classify the image data stored to a memory of the display device into a type that is suitable to the light emitting driving method and to effectively manage the memory.

Meanwhile, when realizing the image for the R, G, and B pixels in the display device, time-division driving for efficiency of image realization is used. In general, the time division means that a time is divided into small segments to form fine time slots when commonly using something, and each time slot is independently used by each user. The time-division driving in the display device is to be multi-displayed during one frame time (1⁄60 Hz=16.667 ms) in which one image is displayed one time.

There are various methods in the driving method of the display device using the time-division driving. However, the time-division driving does not display the complete image at a time such that an arrangement of the data using the memory is required and exists in a predetermined pattern. This appears as a false contour, which is a color division.

In this time-division driving, it is generally necessary to manage the memory for the data arrangement for each field. Particularly, when realizing the image of the R, G, and B pixels through the time-division driving, a color division phenomenon is generated in a 1×1 dot pattern such that the data arrangement method of the memory to prevent the color division phenomenon is required.

Hereinafter, embodiments will be described more fully with reference to the accompanying drawings. As those skilled in the art would realize, the described embodiments may be modified in various different ways, all without departing from the spirit or scope of the present disclosure.

Further, like reference numerals denote like components throughout several embodiments. A first embodiment will be representatively described, and therefore only components other than those of the first embodiment will be described in other embodiments.

The drawings and description are to be regarded as illustrative in nature and not restrictive. Like reference numerals designate similar elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising" will be understood to imply the inclusion of stated elements but not the exclusion of any other elements.

FIG. 1 is a schematic block diagram of a display device according to an embodiment.

Referring to FIG. 1, a display device according to an embodiment includes a display unit 10, a scan driver 20, a data driver 30, and a light emission driver 40.

The display unit 10 includes a plurality of scan lines S1-Sn extending in a row direction, a plurality of light emission control lines EA1-EAn and EB1-EBn extending in a row direction, and a plurality of data lines D1-D extending in a column direction. The light emission control lines EA1-EAn and EB1-EBn include a plurality of first light emission control lines EA1-EAn and a plurality of second light emission control lines EB1-EBn.

Although not shown in FIG. 1, the display unit 10 is connected to a power line supplying driving power to a plurality of pixels included in the display unit, and the power line is connected to a driving power supply unit.

Also, the display unit 10 includes a plurality of pixels PX. Each pixel PX is formed in a pixel area defined by a corresponding scan line among a plurality of scan lines S1-Sn, a corresponding first light emission control line among a plurality of first light emission control lines EA1-EAn, a corresponding second light emission control line among a plurality of second light emission control lines EB1-EBn, and a corresponding data line among a plurality of data lines D1-Dm.

For example, a corresponding pixel 100 is formed in the pixel area defined by the final (n-th) scan line Sn among the scan lines connected to the display unit, the final (n-th) first light emission control line EAn, the final (n-th) second light emission control line EBn, and the final (m-th) data line Dm among the data lines connected to the display unit.

Each pixel PX of the display unit 10 is arranged with an organic light emitting element realizing predetermined R, G, and B colors so as to differentiate a color arrangement of the display image every field driven by the time-division driving during one frame.

The scan driver 20 sequentially applies the scan signal to a plurality of scan lines S1-Sn for the data signal to be written to the pixel connected to the corresponding scan line.

Also, the light emission driver 40 sequentially applies the first light emission control signal to the corresponding first light emission control lines EA1-EAn and the second light emission control signal to the corresponding second light emission control lines EB1-EBn to control the light emitting of the organic light emitting element included in the corresponding pixel PX. That is, each pixel PX includes a plurality of organic light emitting elements realizing the R, G, and B colors, and at this time, the first and second light emission control signals supplied from the light emission driver 40 controls the light emitting for each field for the entire display unit 10 to have a different color arrangement for each field of one frame.

Meanwhile, the data driver 30 applies the corresponding data signal to the corresponding data lines D1-Dm to the pixel of the scan line that is applied with the scan signal whenever the scan signal is sequentially applied. The organic light emitting element of each pixel emits the light through the driving current according to the applied data signal, thereby displaying the image.

The data driver 30 of the display device may store and manage the data signal applied per field to realize the image that emits the light with the different color arrangement pattern every field of one frame according to the control of the first and second light emission control signals supplied from the light emission driver 40. At this time, a storing unit of the data signal stored for each field may be included in the data driver 30, however it is not limited thereto, and the storing unit may be separately formed.

Figure 2:
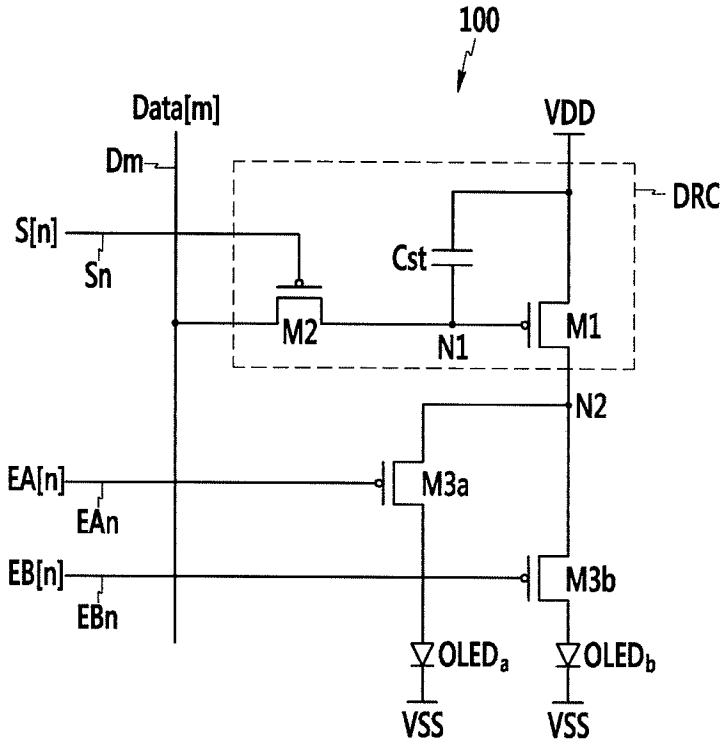
FIG. 2 is a circuit diagram of a constitution of a pixel circuit of a display device according to an embodiment.

FIG. 2 is a circuit diagram of a constitution of a pixel circuit of a display device according to an embodiment. In detail, the pixel 100 of FIG. 2 is a pixel of the pixel area defined by the last row and the last column in the matrix structure of the display unit 10 of FIG. 1.

Referring to FIG. 2, the pixel 100 includes one driver DRC and at least two organic light emitting elements OLEDa and OLEDb emitting the light with the driving current according to the corresponding data signal by the activation of the driver. According to the embodiment of FIG. 2, the pixel 100 includes two organic light emitting elements OLEDa and OLEDb emitting the light in each field when having two fields during one frame such that it is not limited to the embodiment of FIG. 2, and each pixel may include a plurality of organic light emitting elements displaying a plurality of colors.

The driver DRC of the pixel 100 includes a driving transistor M1, a switching transistor M2, and a capacitor. Also, the first organic light emitting element OLEDa is connected to the first light emitting transistor M3*a*, and the second organic light emitting element OLEDb is connected to the second light emitting transistor M3*b*.

In detail, the driving transistor M1 as a transistor to drive the organic light emitting element includes a source electrode connected to the first power VDD supplying the first power source voltage, a gate electrode connected to the first node N1, and a drain electrode connected to the second node N2. The driving transistor M1 controls the driving current flowing to the organic light emitting elements OLEDa and OLEDb through the first light emitting transistor M3*a* and the second light emitting transistor M3*b* connected to the second node N2 by the voltage applied between the gate electrode and the source electrode.

The switching transistor M2 as a transistor activating the driver DRC by selecting the pixel 100 in response to the corresponding scan signal S[n], and includes the source electrode connected to the corresponding data line Dm, the gate electrode connected to the corresponding scan line Sn, and the drain electrode connected to the first node N1. If the switching transistor M2 is turned on in response to the scan signal S[n] supplied through the scan line Sn, the corresponding data signal Data[m] is transmitted through the data line Dm such that the data voltage according thereto is applied to the first node N1.

The capacitor Cst is connected between the first node N1 and the source electrode of the driving transistor M1, and the capacitor Cst includes a first electrode connected to the first node N1 and a second electrode connected to the source electrode of the driving transistor M1. The capacitor Cst stores a voltage according to a voltage difference applied to both electrodes, and at this time, if the driver DRC is activated such that the data voltage according to the data signal is applied to the first electrode, the capacitor Cst stores the voltage corresponding to the difference along with the first power source voltage applied to the second electrode. The driving current is generated according to the corresponding voltage, and the driving current flows to the organic light emitting element.

Meanwhile, the first light emitting transistor M3*a* as a transistor controlling the light emitting of the first organic light emitting element OLEDa includes the source electrode connected to the second node N2, the gate electrode connected to the corresponding first light emission control line EAn, and the drain electrode connected to the anode of the first organic light emitting element OLEDa.

The second light emitting transistor M3*b* as a transistor controlling the light emitting of the second organic light emitting element OLEDb includes the source electrode connected to the second node N2, the gate electrode connected to the corresponding second light emission control line EBn, and the drain electrode connected to the anode of the second organic light emitting element OLEDb.

The display device according to an embodiment has a display unit that is driven in time-division with two fields during one frame, and for this driving, the pixel 100 of FIG. 2 has two organic light emitting elements emitting light with different colors in two fields. For example, the first organic light emitting element OLEDa emits the light according to the driving current by the turn-on of the first light emitting transistor M3*a* in the first field. Also, the second organic light emitting element OLEDb emits the light according to the driving current by the turn-on of the second light emitting transistor M3*b* in the second field. At this time, the first light emitting transistor M3*a* is turned on in response to the first light emission control signal EA[n] applied to the gate electrode, and the second light emitting transistor M3*b* is turned on in response to the second light emission control signal EB[n] applied to the gate electrode.

Two organic light emitting elements OLEDa and OLEDb emit the different colors according to the driving current applied to each anode, thereby emitting the light of red-green, blue-red, or green-blue. That is, a plurality of pixels included in the display unit may include two organic light emitting elements emitting light like the combination of the colors.

Also, according to an embodiment, the cathode of two organic light emitting elements OLEDa and OLEDb is connected to the second power VSS supplying the second power source voltage that is lower than the first power source voltage. The second power source voltage may be a negative voltage or a ground voltage.

A color arrangement pattern and a light emission control method according to the time-division driving of the display unit including the matrix structure of a plurality of pixels having the circuit constitution like the embodiment of FIG. 2 will be described with reference to FIG. 7 to FIG. 9.

Figure 3:
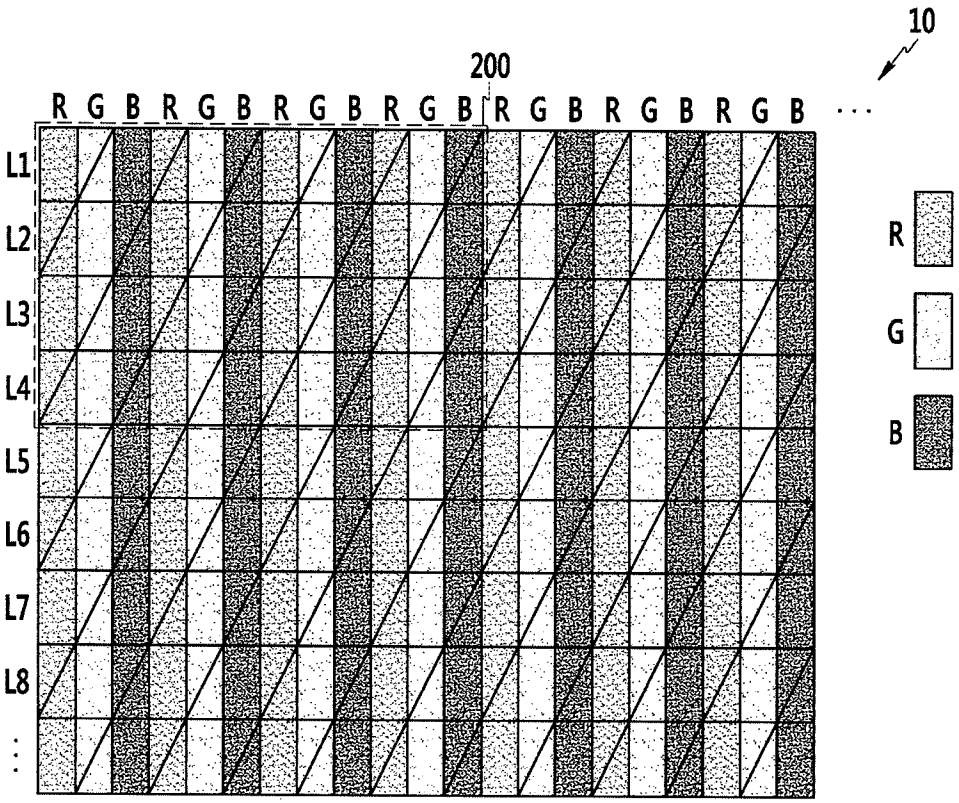
FIG. 3 is a view of a pixel arrangement shape of a display device according to an embodiment.
Figure 4A:
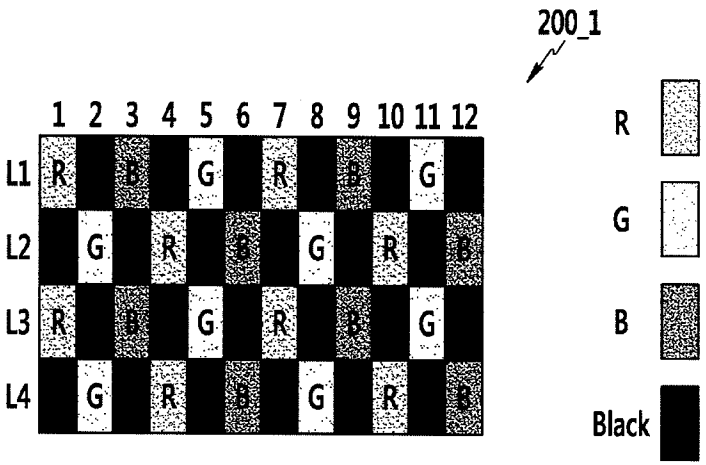
FIG. 4A and FIG. 4B are views of a pattern of a display unit realizing a white image of a display device.
Figure 4B:
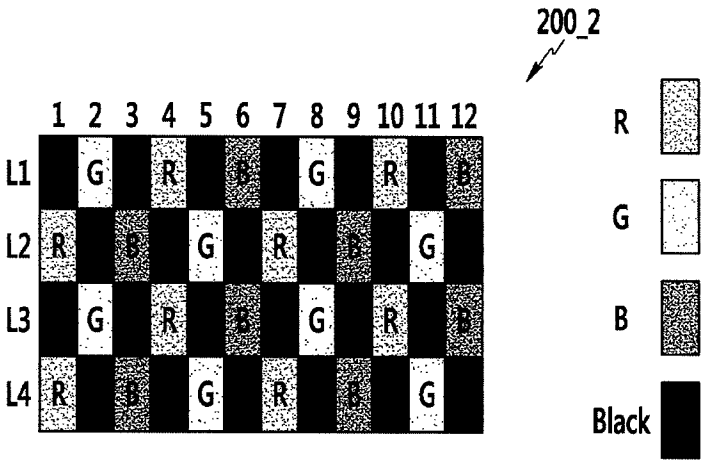

FIG. 3 is a view of a pixel arrangement shape of a display device according to an embodiment, and FIG. 4A and FIG. 4B are views of a pattern of a display unit realizing a white image of a display device.

In detail, the pixel arrangement of FIG. 3 represents the arrangement sequence of the color emitted by at least two organic light emitting elements included in each pixel as shown in FIG. 2. Also, FIG. 4A and FIG. 4B show the color arrangement pattern of the organic light emitting element of the pixels realizing a full white image in the time-division driving in which one frame is divided into two fields and driven.

Referring to FIG. 3, the organic light emitting elements of each pixel of the display device are arranged with the organic light emitting elements emitting the light of red, green, and blue in the row direction, and emitting the same color in the column direction. Accordingly, the organic light emitting elements of red, green, and blue are equally arranged for a plurality of lines L1, L2, L3 . . . , .

If the organic light emitting elements of the pixel of the slashed portion of FIG. 3 are divided, the organic light emitting element of the pixels may be arranged in the first field among two fields like FIG. 4A. Also, if only the organic light emitting elements of the pixel of the slashed portion of FIG.

3 are arranged, the organic light emitting element of the pixels may be arranged in the second field different from the first field like FIG. 4B.

If the image emitting the light with the full white during one frame is realized, the organic light emitting elements of each pixel of the display unit emit the light of each color with the shape like FIG. 4A in the first field and the shape like FIG. 4B in the second field. In the realization of this image, the color division is not shown in the general arrangement pattern in the pixel.

Figure 5:
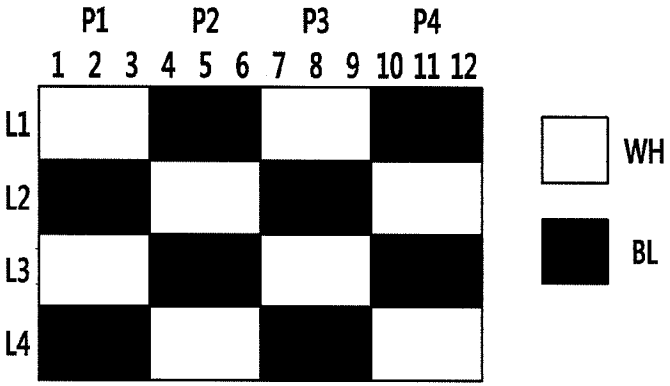
FIG. 5 is a view of one example of a pattern of a display unit used for a specification test of a display device.

However, when displaying the image according to one example the pattern of the display unit used to a specification test of the display device as shown in FIG. 5, the color division phenomenon is increased in the arrangement shape of the organic light emitting element of each pixel of the display unit.

FIG. 5 shows that an image is displayed with a 1×1 dot pattern (hereinafter, 1 dot pattern) among the pattern of the display unit used to the specification test of the display device. In FIG. 5, a white color and a black color are alternately arranged in an up/down and right/left direction with the same proportion. However, the 1 dot pattern is not limited to the repetition image realization of the color like FIG. 5.

In FIG. 5, three organic light emitting elements are grouped in one, and all express the R, G, and B colors to display the white color, or the light is not emitted or the black data is transmitted to display the black color. Hereafter, three organic light emitting elements are grouped in one group and are referred to as dot regions P1, P2, P3, and P4.

Figure 6A:
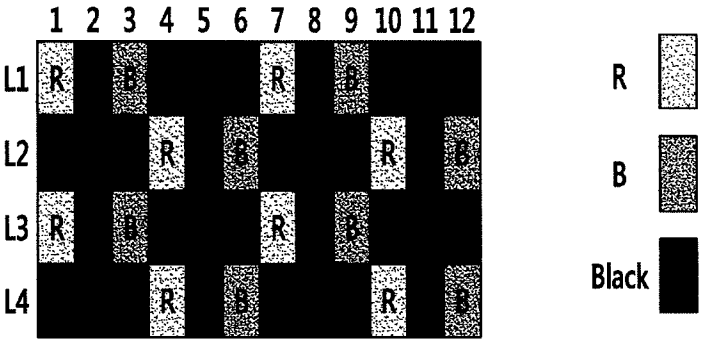
FIG. 6A and FIG. 6B are views of an arrangement shape of a pixel during 1 frame period in a display device when realizing the pattern of FIG. 5.
Figure 6B:
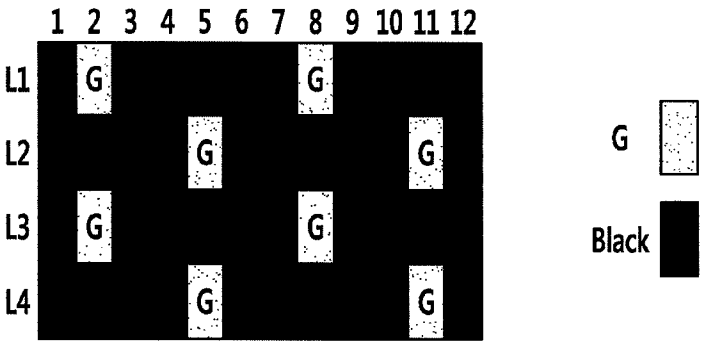

FIG. 6A and FIG. 6B are views of an arrangement shape of an organic light emitting element of a pixel represented in each field during one frame period when realizing the 1 dot pattern of FIG. 5 with the time-division driving.

That is, FIG. 6A shows the arrangement shape of the organic light emitting element of the pixels emitting the light of each color by data writing according the 1 dot pattern in the first field. Further, FIG. 6B shows the arrangement shape of the organic light emitting element of the pixels emitting the light of each color by data writing according the 1 dot pattern in the second field. Referring to the arrangement shape of the organic light emitting element of the pixels shown in FIG. 3, when writing the data of the 1 dot pattern of FIG. 5, the first field emits the light through the red and blue elements in one dot region (an RB dot region) as shown in FIG. 6A, and the black data is written or no organic light emitting element emits the light in the other one dot region (a Black dot region). The RB dot region and the Black dot region are crossed and arranged in the up/down and right/left directions. That is, the arrangement pattern of the dot region of one line (e.g., L2) and the other line (e.g., L1 or L3) neighboring thereto has a structure such that the RB dot region and the Black dot region are alternately arranged.

Meanwhile, the second field emits the light by the green element in one dot region (G dot region) like FIG. 6B, and the black data is inserted or all organic light emitting elements do not emit the light in the other dot region (Black dot region). The G dot region and the Black dot region are crossed and arranged in the up/down and right/left direction. That is, the arrangement pattern of the dot region of one line (e.g., L2) and the other line (e.g., L1 or L3) neighboring thereto has a structure such that the G dot region and the Black dot region are alternately arranged.

Accordingly, if the first field of FIG. 6A and the second field of FIG. 6B are continuously arranged for one frame, the color division phenomenon is seriously generated in the 1 dot pattern. That is, the green color having a luminance level that is relatively higher than the red and blue colors is divided into the field and displayed such that the data input displays the serious color division phenomenon to the user in the 1 dot pattern.

Figure 7A:
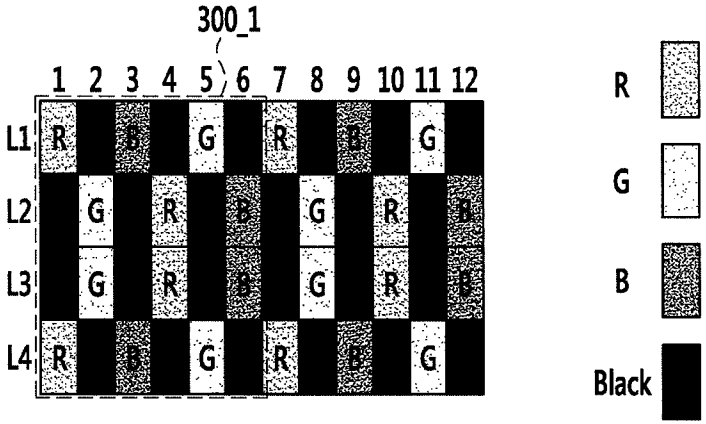
FIG. 7A and FIG. 7B are views of an arrangement shape of a pixel during 1 frame period in a display device according to an embodiment when realizing the pattern of FIG. 5.
Figure 7B:
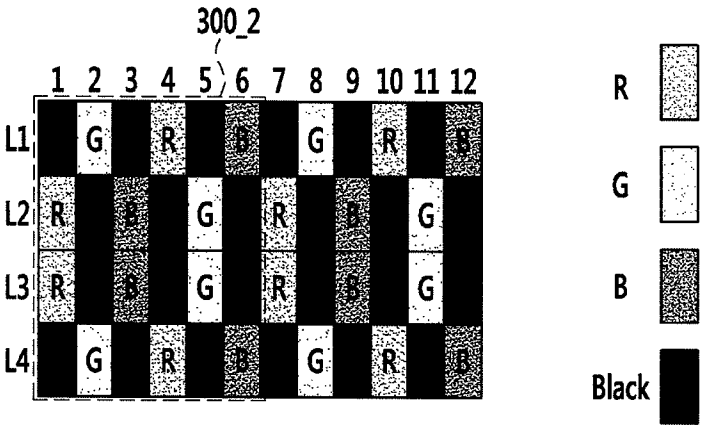

At least one of the disclosed embodiments realizes the RGB color to be mixed for each field by changing the data pattern to decrease and remove the color division phenomenon in the 1 dot pattern. FIG. 7A and FIG. 7B show a color arrangement pattern for each field of the pixel that is driven with the time-division during one frame period proposed according to an embodiment to decrease or suppress the color division phenomenon under the realization of the 1 dot pattern of FIG. 5. As described above, the organic light emitting elements of each pixel is disposed like FIG. 3. That is, the organic light emitting elements of red, green, and blue are equally disposed for a plurality of lines L1, L2, L3, and L4. FIG. 7A and FIG. 7B show an arrangement sequence of the color displayed for each field when selectively emitting the light with the light emission control by the organic light emitting elements of the pixel arranged like FIG. 3.

Referring to FIG. 7A and FIG. 7B, the color pattern according to each field is repeated as a unit region including two dot regions included in four lines L1, L2, L3, and L4. These unit regions are defined as a repetition pattern unit (300_1 and 300_2).

Each dot region corresponds to three organic light emitting elements such that two dot regions for each line correspond to six organic light emitting elements, that is, three pixels. Accordingly, the region corresponding to the repetition pattern unit includes four first pixels including the organic light emitting elements corresponding to the first and second columns for four lines, four second pixels including the organic light emitting elements corresponding to the third and fourth columns. The region further includes four third pixels including the organic light emitting elements corresponding to the fifth and sixth columns, and the repetition pattern unit is a pattern of the color represented by emitting the light by one element among two organic light emitting elements included in four first pixels to third pixels according to the light emission control.

In detail, referring to the repetition pattern unit 300_1 of FIG. 7A, in the first field, if the corresponding data signal is written, one of the elements among the organic light emitting elements of the first to third pixels included in the first line L1 and the fourth line L4 is selected and they respectively emit the same color. That is, the one of the elements as the organic light emitting elements respectively corresponding to the first, third, and fifth columns corresponds to the EL elements of red, blue, and green. Also, the other elements among the organic light emitting elements of the first to third pixels included in the second line L2 and the third line L3 is selected and they emit the light of the same color. At this time, the other elements as the organic light emitting elements corresponding to the second, fourth, and six columns correspond to the EL elements of green, red, and blue.

Meanwhile, referring to the repetition pattern unit 300_2 of FIG. 7B, in the second field, the other elements among the organic light emitting elements of the first to third pixels included in the first line L1 and the fourth line L4 are selected and emit light of the same color. The other elements as the organic light emitting elements corresponding to the second, fourth, and sixth columns correspond to the EL elements of green, red, and blue. Also, one of the elements among the organic light emitting elements of the first to third pixels include in the second line L2 and the third line L3 is selected and they emit light of the same color. At this time, the one of the elements as the organic light emitting elements corresponding to the first, third, and fifth columns corresponds to the EL elements of red, blue, and green.

Meanwhile, the light emitting of the organic light emitting elements that are not selected in the repetition pattern unit are blocked such that the black image is displayed. However, according to another driving method, the black data is written to the non-selected organic light emitting element, thereby being displayed as the black image.

Meanwhile, the repetition pattern unit of each of FIG. 7A and FIG. 7B refers to the pattern with which the organic light emitting element for each color of the pixels is arranged according to the embodiment of FIG. 3 (an RGB arrangement pattern of the row direction) and is displayed according thereto, and this embodiment is not limited.

Accordingly, although the color realization of the organic light emitting element in the row direction is different from the RGB pattern like FIG. 3 (or it is a case of a pentile structure of RGBG), the repetition pattern unit of FIG. 7A or FIG. 7B may be applied. In this case, although the color shown in FIG. 7A or FIG. 7B is not displayed, one of the elements among the organic light emitting elements of the first to third pixels included in the first line L1 and the fourth line L4 is selected in the first field, and the other elements among the organic light emitting elements of the first to third pixels included in the second line L2 and the third line L3 are selected in the first field to display the color. Also, the organic light emitting elements are selected reversely to the first field in the second field.

Figure 12A:
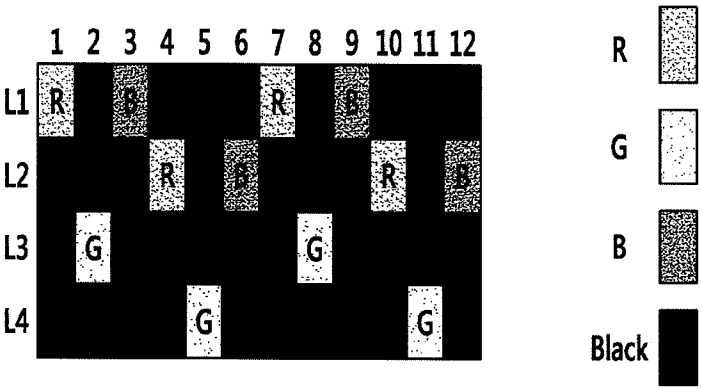
FIG. 12A and FIG. 12B are views of an arrangement shape of a pixel in which color division is reduced or removed according to a memory managing method of image data according to an embodiment.
Figure 12B:
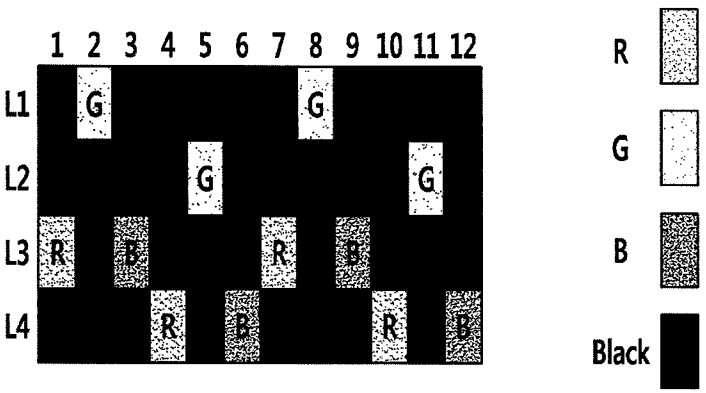

According to an embodiment, when displaying the image according to a data signal written with the 1 dot pattern like FIG. 5 based on the repetition pattern unit 300_1 of FIG. 7A corresponding to the first field and the repetition pattern unit 300_2 of FIG. 7B corresponding to the second field, each field may be displayed like FIG. 12A and FIG. 12B. That is, FIG. 12A and FIG. 12B are views of color realization of the organic light emitting element of the first field and the second field under the pattern realization of FIG. 5 according to a memory manage method of image data according to an embodiment.

Referring to FIG. 12A and FIG. 12B, when each field is continuously displayed during one frame, although the 1 dot pattern in which a white dot region and a black dot region are crossed in the up/down and right/left directions is realized, a distribution ratio of the RG dot region and the G dot region represented in FIG. 12A of the first field and the RG dot region and the G dot region represented in FIG. 12B of the second field is the same. That is, the RB dot region is represented as the 1 dot pattern to the first line L1 and the second line L2 in FIG. 12A of the first field and the G dot region is represented as the 1 dot pattern to the third line L3 and the fourth line L4. However, the color pattern of the arrangement shape that is reversed with regard to the first field is realized in FIG. 12B of the second field. This is due to the arrangement of the data pattern as in the embodiment of FIG. 7A and FIG. 7B. Accordingly, referring to FIG. 12A and FIG. 12B, the color division of the red-blue and the green according to the field is not generated under the realization of the 1 dot pattern by the time-division driving method, thereby obtaining an effect of reducing and removing the false contour or the color division phenomenon.

Figure 8A:
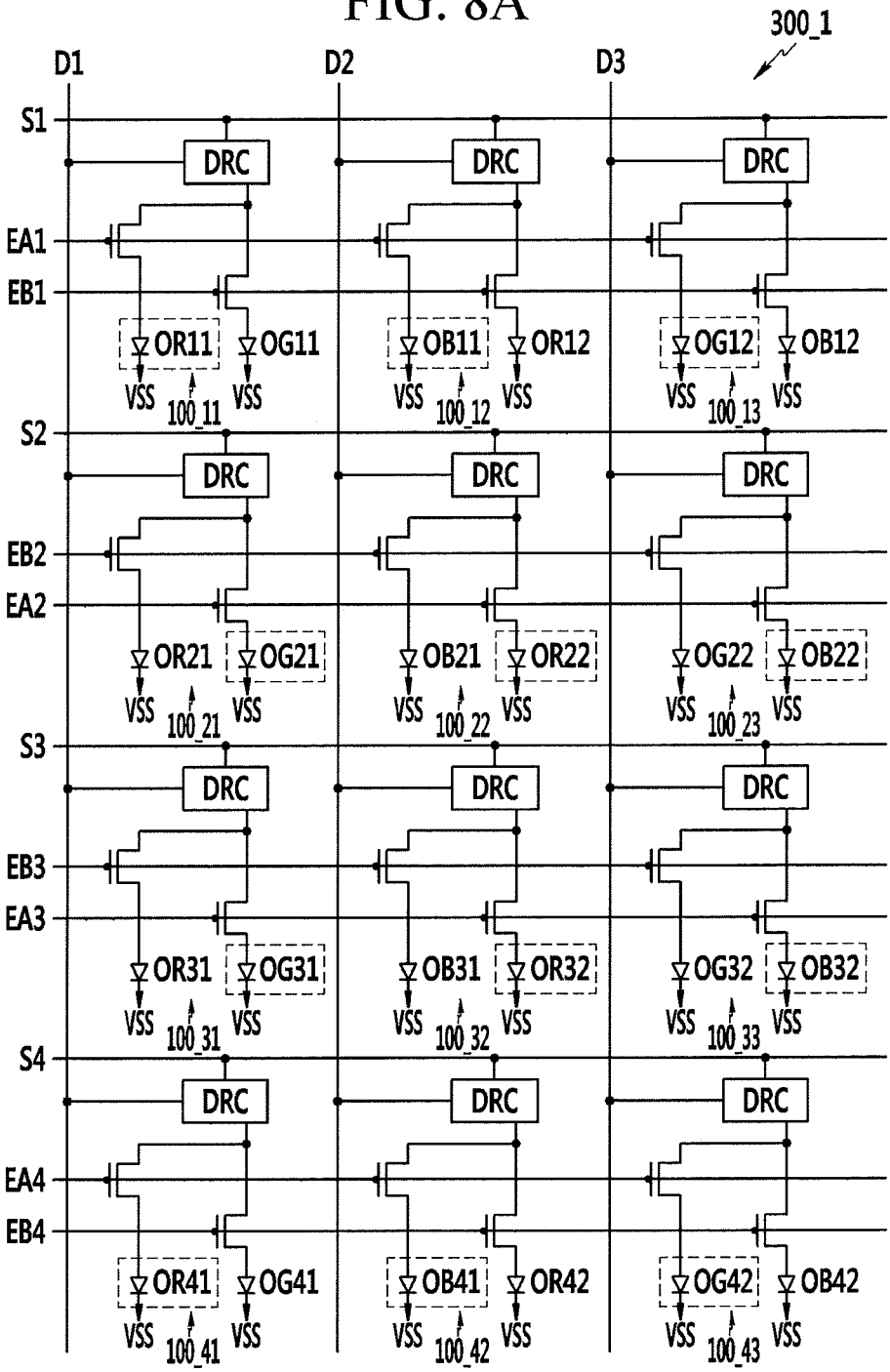
FIG. 8A and FIG. 8B are views to schematically explain pixel driving according to each arrangement of FIG. 7A and FIG. 7B.
Figure 8B:
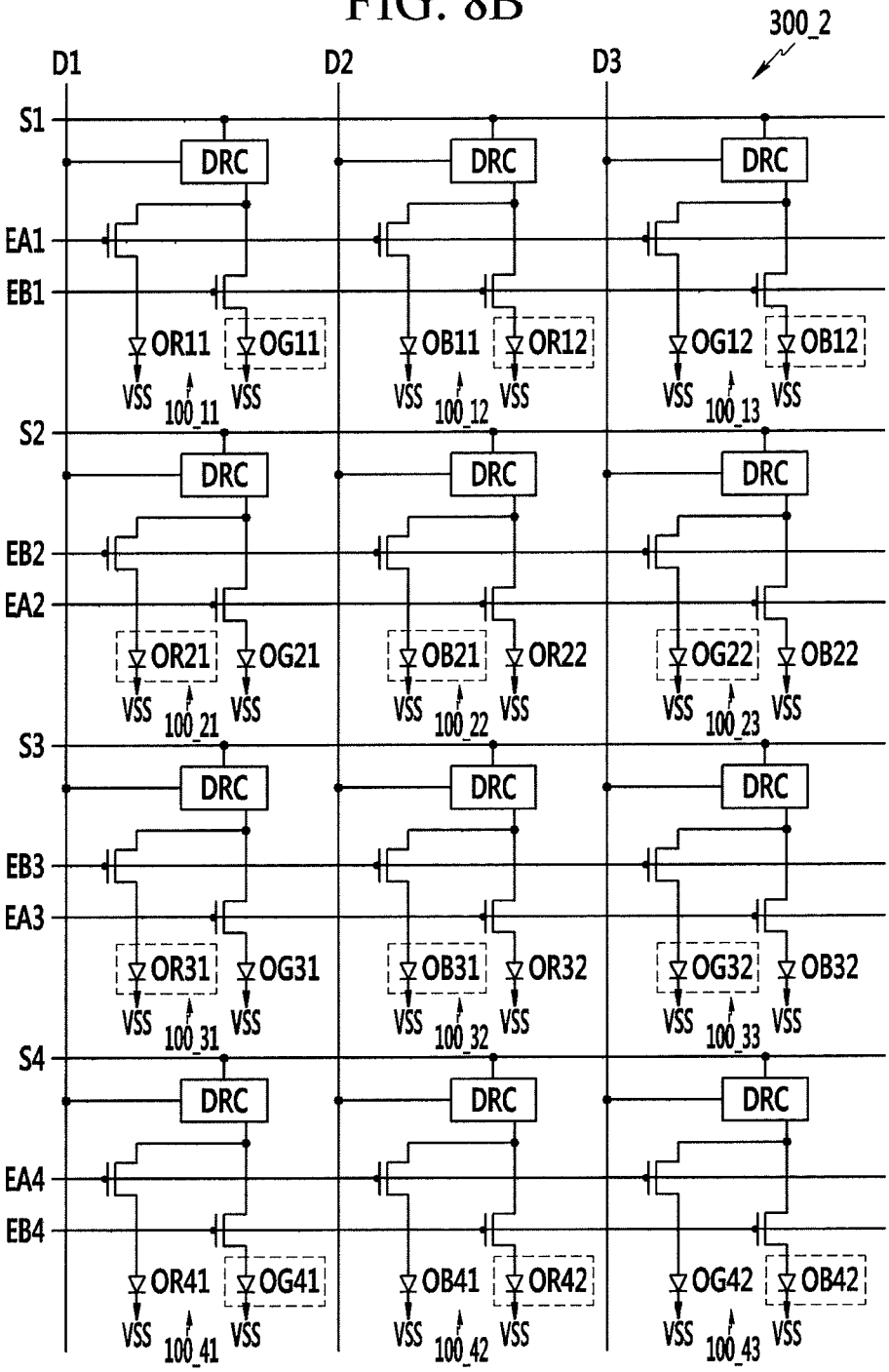

FIG. 8A is a circuit diagram to explain pixel driving corresponding to the repetition pattern unit 300_1 in the first field of FIG. 7A. FIG. 8B is a circuit diagram to explain pixel driving corresponding to the repetition pattern unit 300_2 in the second field of FIG. 7B.

The pixel circuit structures included in the repetition pattern unit of FIG. 8A and FIG. 8B are the same, however, the organic light emitting element emitting the light in the corresponding field is different. Accordingly, for better understanding and ease of description, it will be described focusing on FIG. 8A.

Referring to FIG. 8A and FIG. 8B, when focusing on the repetition pattern unit, the arrangement structure of each pixel included in the display unit is the same as the circuit diagram of FIG. 2. Accordingly, the driver DRC of the pixel that is activated by the input of the corresponding scan signal is the same as the description of FIG. 2.

In FIG. 7A and FIG. 7B, the repetition pattern unit means a color pattern of the region corresponding to the first pixel to the third pixel included in the first line L1 to the fourth line L4, such that FIG. 8A and FIG. 8B show the first pixel to the third pixel respectively included in the first line L1 to the fourth line L4. In detail, the first pixel 100_11, the second pixel 100_12, and the third pixel 100_13 are included in the first line L1, the first pixel 100_21, the second pixel 100_22, and the third pixel 100_23 are included in the second line L2. The first pixel 100_31, the second pixel 100_32, and the third pixel 100_33 are included in the third line L3, and the first pixel 100_41, the second pixel 100_42, and the third pixel 100_43 are included in the fourth line L4.

These pixels respectively include two organic light emitting elements and they are donated by one element and the other element in the above description.

One element and the other element of the first to third pixels of each line L1, L2, L3, and L4 corresponding to the same column as the organic light emitting element emitting the light of the same color are repeated and disposed with the RGB sequence in the row direction, as shown in FIG. 3.

That is, for example, if the row direction arrangement of the organic light emitting element of the pixels of the first line L1 will be described, the first pixel 100_11 includes the red organic light emitting element OR11 of one element and the green organic light emitting element OG11 of the other element. The second pixel 100_12 includes the blue organic light emitting element OB11 of one element and the red organic light emitting element OR12 of the other element. The third pixel 100_13 includes the green organic light emitting element OG12 of one element and the blue organic light emitting element OB12 of the other element. Next, the pixels of the second line L2 to the fourth line L4 in the repetition pattern unit include the organic light emitting element that is arranged the same as a chromophore pattern of the organic light emitting elements included in the first line L1.

Also, in the repetition pattern unit of FIG. 8A and FIG. 8B, the anodes of two organic light emitting elements included in one pixel are connected to the light emitting transistor controlling the light emitting driving by controlling the flow of the driving current as shown in FIG. 2. The light emitting transistor is switched by receiving the light emission control signal from the light emission control line connected to the corresponding gate electrode.

To manage the image data memory according to an embodiment, the arrangement of the light emission control line corresponding to the driving of the pixels according to each arrangement of FIG. 7A and FIG. 7B is used.

In the repetition pattern unit of FIG. 8A and FIG. 8B, two light emission control lines are connected for each line, and separated from the scan line connected to the driver DRC. That is, the first light emission control line transmitting the first light emission control signal to control the light emitting in the first field and the second light emission control line transmitting the second light emission control signal to control the light emitting in the second field are connected for each pixel lines L1, L2, L3, and L4. Two light emission control lines connected to one pixel line are connected to the gate electrode of the light emitting transistor controlling the driving of the organic light emitting element, however the connection sequence of two light emission control lines is different for each line in the repetition pattern unit.

That is, the first-first light emission control line EA1 is connected to the gate electrode of the light emitting transistor connected to one element of the first to third pixels 100_11 to 100_13 included in the first line L1, and the first-second light emission control line EB1 is connected to the gate electrode of the light emitting transistor connected to the other element. Thus, in the first field of FIG. 8A, in response to the first light emission control signal applied to the first-first light emission control line EA1, the organic light emitting elements of R, B, and G for the first to third pixels 100_11 to 100_13 of the first line L1 emit the light like the dotted line portion. In contrast, in the second field of FIG. 8B, in response to the second light emission control signal applied to the first-second light emission control line EB1, the organic light emitting elements of G, R, and B for the first to third pixels 100_11 to 100_13 of the first line L1 emit the light like the dotted line portion.

Meanwhile, the connection pattern of the first and second light emission control lines connected to the first to third pixels 100_21 to 100_23 included in the second line L2 is opposite to that of the first line. That is, the second-second light emission control line EB2 is connected to the gate electrode of the light emitting transistor connected to one element of the elements of the second line L2, and the second-first light emission control line EA2 is connected to the gate electrode of the light emitting transistor connected to each other element. Thus, in the first field of FIG. 8A, in response to the first light emission control signal applied to the second-first light emission control line EA2, the organic light emitting element of G, R, and B for the first to third pixels 100_21 to 100_23 of the second line L2 emit the light like the dotted line portion. In contrast, in response to the second light emission control signal applied to the second-second light emission control line EB2 in the second field of FIG. 8B, the organic light emitting element of R, B, and G for the first to third pixels 100_21 to 100_23 of the second line L2 emit the light like the dotted line portion.

Also, the connection pattern of the third-first and second light emission control lines EA3 and EB3 connected to the first to third pixels 100_31 to 100_33 included in the third line L3 is the same as that of the second line. Thus, in FIG. 8A, the organic light emitting element of G, R, and B emit the light like the dotted line, and in FIG. 8B, the organic light emitting elements of R, B, and G emit the light like the dotted line portion.

Finally, in the circuit structure of the repetition pattern unit, the connection pattern of the fourth-first and second light emission control lines EA4 and EB4 connected to the first to third pixels 100_41 to 100_43 in the fourth line L4 is the same as that of the first line. Thus, in FIG. 8A of the first field, the organic light emitting elements of R, B, and G emit the light like the dotted line portion, and in FIG. 8B, the organic light emitting elements of G, R, and B emit the light like the dotted line portion.

That is, according to an embodiment, the data of the different colors is written in each field forming one frame, and the light is emitted according to two light emission control signals controlling the light emitting of each field. The light emitting pattern of the display unit repeats the repetition pattern unit of each field such that the first field and the second field continuously display the image during one frame, however, each field is sequentially performed until the last line in the row direction and the column direction. In general, the frames of 60 pieces per second may be output.

Figure 9:
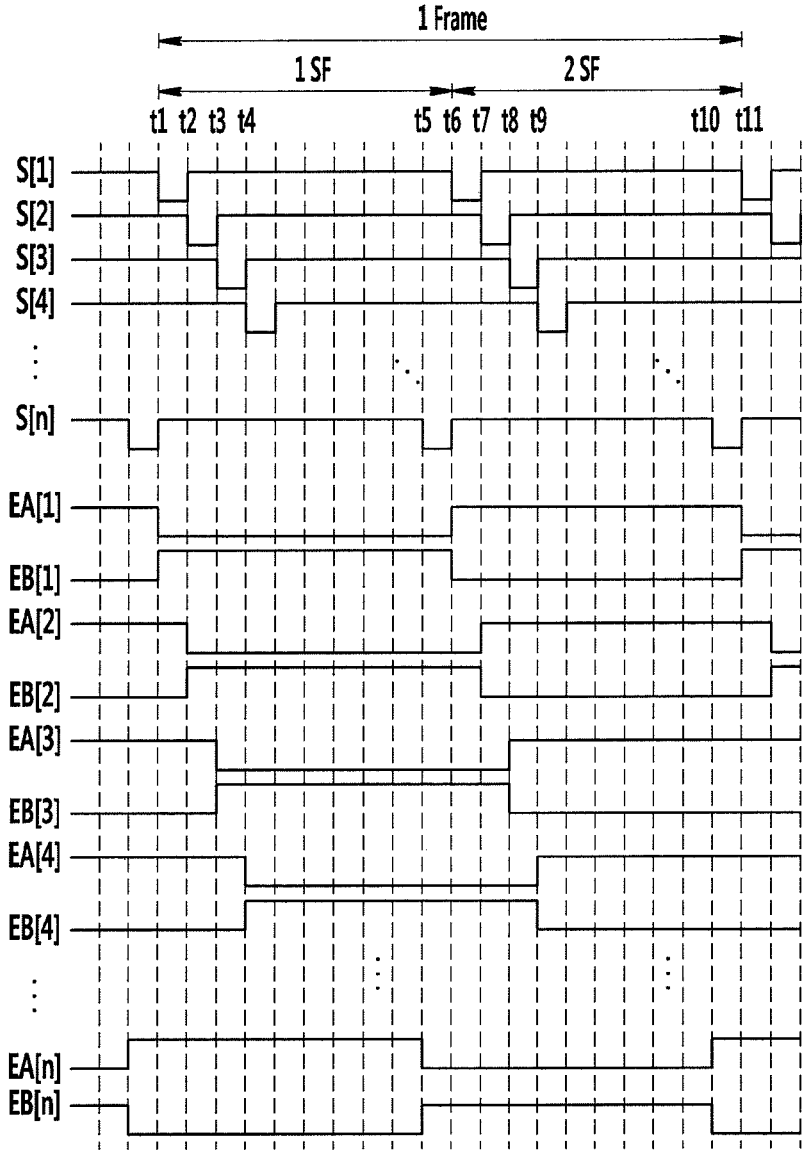
FIG. 9 is a timing diagram to explain light emitting driving according to FIG. 8A and FIG. 8B.

FIG. 9 is a timing diagram to explain light emitting driving according to FIG. 8A and FIG. 8B. A driving process of the light emission control will be described with reference to the circuit structure corresponding to the repetition pattern unit of the display unit according to an embodiment shown in FIG. 8A and FIG. 8B.

The display device according to an embodiment is divided into two fields 1SF and 2SF and driven during one frame (1Frame). One frame and the next frame are divided by the vertical synchronization signal Vsync applied to the display device. In FIG. 9, one frame is started by the vertical synchronization signal Vsync applied directly after the time t1 and the time t11.

The light emitting is continuously performed in two fields during one frame to realize the image of one frame of the entire display unit such that a plurality of scan signals transmitted to the display unit are transmitted as a turn-on level voltage of the transistor with an interval of ½ frame period. In one embodiment, the pixels include a PMOS transistor as shown in FIG. 2 such that the turn-on level voltage of the signals in FIG. 9 becomes a low level voltage.

Also, a plurality of the first and second light emission control signals transmitted to the first and second light emitting transistors controlling the light emitting of the organic light emitting element of the pixels are applied while differentiating a phase per interval of the ½ frame period. Also, the first light emission control signal for the light emitting of the organic light emitting elements in the first field and the second light emission control signal for the light emitting of the organic light emitting elements in the second field have an opposite voltage level in each field.

In detail, referring to FIG. 9, in each of fields 1SF and 2SF, a plurality of scan lines connected to each pixel line are sequentially applied with a plurality of scan signals. That is, the first scan signal S[1] to the last scan signal S[n] as the low level voltage are sequentially applied to the first scan line to the last scan line at the times t1, t2, t3, t4, . . . , t5 of the first field 1SF. Thus, the driver DRC of the pixels included in each pixel line is sequentially activated. Likewise, the first scan signal S[1] to the last scan signal S[n] as the low level voltage are sequentially applied to the first scan line to the last scan line at the times t6, t7, t8, t9, . . . , t10 of the second field 1SF following a time that the first field 1SF is finished. Thus, the driver DRC of the pixels included in each pixel line is sequentially activated.

According to the application of a plurality of scan signal, the data voltage according to the data signal is transmitted to each pixel from the corresponding data line such that the driving current flows to the organic light emitting element of each pixel, and at this time, the selection of two organic light emitting elements included in each pixel and the light emitting thereof is the same as the description of FIG. 8A and FIG. 8B. As described above, the selective light emitting driving of the organic light emitting element according to the field is controlled by the first light emission control signal and the second light emission control signal.

In detail, if the first scan signal S[1] of the low level is applied to the first scan line at the time t1, and the data signals corresponding to the first field are applied from the corresponding data lines D1 to D3 to the pixel included in the first pixel line. The data voltage according to the data signals is stored in the capacitor of each pixel. Also, in synchronization with the first scan signal S[1] of the low level, the first light emission control signal EA[1] is converted into the low level voltage and is applied to the first-first light emission control line, and the second light emission control signal EB[1] is converted into the high level voltage of the reversed phase and is applied to the first-second light emission control line. Referring to FIG. 8A showing the pixel corresponding to the repetition pattern unit of the first field, the first light emission control signal EA[1] is connected to the gate electrode of the light emitting transistor connected to one element of the pixels 100_11 to 100_13 of the first pixel line. The second light emission control signal EB[1] is connected to the gate electrode of the light emitting transistor connected to the other element of the pixels 100_11 to 100_13 of the first pixel line. Accordingly, in response to the first light emission control signal EA[1] of the low level voltage, the light emitting transistor connected to one element of each pixel of the first pixel line is turned on. Thus, the driving current corresponding to the data voltage applied through the light emitting transistor is transmitted to the organic light emitting element of one side, thereby emitting the light. The light of the RBG color is emitted in the row direction of the first line.

At this time, the light emitting transistor connected to the other element of each pixel of the first pixel line is turned off by the second light emission control signal EB[1] of the high level voltage, and thereby the organic light emitting element of the other side does not emit the light.

Meanwhile, in the second field, the first scan signal S[1] is again applied as the low level to the first scan line at the time t6, and in synchronization thereto, the voltage phase of the first light emission control signal EA[1] and the second light emission control signal EB[1] transmitted to the first-first and second light emission control line is reversely changed. Accordingly, referring to FIG. 8B showing the pixel corresponding to the repetition pattern unit of the second field, the light emitting transistor connected to the other element of each of the first pixel line is turned on by the second light emission control signal EB[1] that is converted into the low level voltage and applied in the second field. Thus, the driving current corresponding to the data voltage applied by the first scan signal S[1] transmitted at the time t6 is transmitted to the organic light emitting element of the other side of each pixel of the first pixel line, thereby emitting the light. The light of the GRB color is emitted in the row direction of the first line.

At this time, the light emitting transistor connected to one element of each pixel of the first pixel line is turned off by the first light emission control signal EA[1] that is converted into the high level voltage and applied, and thereby the organic light emitting element of the other side does not emit the light.

Likewise, in a case of the rest of the pixel lines, in synchronization with the scan signal that is sequentially applied according to each pixel line, the first and second light emission control signals are sequentially applied as the low level voltage and the high level voltage in the first field 1SF, and the first and second light emission control signals are converted into the high level voltage and the low level voltage and are sequentially applied in the second field 2SF. Thus, the dotted line portion of FIG. 8A emits the light in the first field 1SF, and the dotted line portion of FIG. 8B emits the light in the second field 2SF.

FIG. 10 is a view of an input data map of a display device according to an embodiment. In FIG. 10, the input data is divided with reference to the color data signal input to two organic light emitting elements included in the pixel, not the pixel. That is, to display the input data map for each field by the memory management method of the image data of the present invention, at least one repetition pattern unit among the display unit displays the data input to the organic light emitting element of the pixels of the corresponding region. In one embodiment, the display unit 10 includes the organic light emitting element as shown in FIG. 3 such that the data input from the data driver 30 are sequentially arranged corresponding to the sequence of the red (R) organic light emitting element, the green (G) organic light emitting element, and the blue (B) organic light emitting element for each line.

FIG. 11 is an input data map for a field by a memory management method of an image data according to an embodiment. In detail, the memory map of the data input to the first field and the second field may be divided and managed for the light to be emitted according to the repetition pattern unit of the pixels of FIG. 7A and FIG. 7B.

The input data map like FIG. 10 is divided into the data memory map of the first field 1SF and the second field 2SF.

That is, in the first field 1SF, as shown in FIG. 7A, the organic light emitting elements corresponding to the odd-numbered (1, 3, 5, 7, 9, and 11) of the first line L1 and the fourth line L4 emit the light to display the RBGRBG color, and thereby the input data of the corresponding position is divided and mapped from the input data map of FIG. 10. Also, the organic light emitting element corresponding to the even-numbered (2, 4, 6, 8, 10, and 12) of the second line L2 and the third line L3 emit the light to display the GRBGRB color, and thereby the input data of the corresponding position is divided and mapped from the input data map of FIG. 10.

Also, in the second field 2SF, as shown in FIG. 7B, the organic light emitting elements corresponding to the even-numbered (2, 4, 6, 8, 10, and 12) of the first line L1 and the fourth line L4 emit the light to display the GRBGRB color, and thereby the input data of the corresponding position is divided and mapped from the input data map of FIG. 10. Also, the organic light emitting element corresponding to the odd-numbered (1, 3, 5, 7, 9, and 11) of the second line L2 and the third line L3 emit the light to display the RBGRBG color, and thereby the input data of the corresponding position is divided and mapped from the input data map of FIG. 10.

The input data that is divided and mapped is stored in the storage. The data driver receives the data signals from the data map stored to the storing unit according to the light emitting driving sequence and applies them to each pixel of the display unit to display the image.

According to at least one of the disclosed embodiments, the image data stored to the memory of the display device is arranged to be suitable for the light emitting driving method and the memory to be efficiently managed.

Particularly, arranging the memory data according to access by time-division driving technique, the phenomena of false contour or color division are minimized or prevented, thereby realizing a high quality image.

While the above embodiments have been described in connection with the accompanying drawings, it is to be understood that the present disclosure is not limited to the disclosed embodiments, but, on the contrary, is intended to cover various modifications and equivalent arrangements included within the spirit and scope of the appended claims.

What is claimed is:

1. A display device comprising:

a display unit comprising a plurality of pixels which include a first light emitting element emitting light in a first field and a second light emitting element emitting light in a second field; and a data driver configured to transmit a first field data signal and a second field data signal to at least a group of pixels defined by four continuous pixel rows and three continuous pixel columns, wherein the first field data signal and the second field data signal are extracted from an input data signal that is divided into the first field and the second field according to a light emitting driving sequence, wherein each of the first and second field data signals includes a color data signal pattern in which a first pair of pixels in each of the same pixel columns of the first and fourth pixel rows are configured to display the same color, and a second pair of pixels in each of the same pixel columns of the second and third pixel rows are configured to display the same color.

2. The display device of claim 1, further comprising a scan driver configured to sequentially supply a corresponding scan signal to a plurality of scan lines connected to a plurality of pixels according to the pixel rows so as to drive each pixel.

3. The display device of claim 1, wherein each of the first and second pairs of the pixels comprise two light emitting elements configured to emit light of the same color.

4. The display device of claim 3, wherein an arrangement sequence of colors emitted by the two light emitting elements is a sequence of a first color, a second color, and a third color.

5. The display device of claim 1, wherein the first and second field data signals are crossed with different colors from each other.

6. The display device of claim 5, wherein the first field data signal includes i) the combination of a first color data signal, a third color data signal, and a second color data signal sequentially applied to three pixels included in the first pixel row and the fourth pixel row, and ii) the combination of the second color data signal, the first color data signal, and the third color data signal sequentially applied to three pixels included in the second pixel row and the third pixel row.

7. The display device of claim 5, wherein the second field data signal includes i) a second color data signal, a first color data signal, and a third color data signal sequentially applied to three pixels included in the first pixel row and the fourth pixel row, and ii) the first color data signal, the third color data signal, and the second color data signal sequentially applied to three pixels included in the second pixel row and the third pixel row.

8. The display device of claim 1, wherein the pixels include first and second elements as at least two light emitting elements, and wherein the display unit includes a first light emitting transistor configured to control the light emitting of the first element and a second light emitting transistor configured to control the light emitting of the second element, wherein the display unit has i) a first wire connection shape such that a first light emission control line is connected to the gate electrode of each first light emitting transistor of a plurality of pixels included in the first pixel row and a second light emission control line is connected to the gate electrode of the second light emitting transistor of a plurality of pixels included in the first pixel row, ii) a second wire connection shape such that the second light emission control line is connected to the gate electrode of each first light emitting transistor of a plurality of pixels included in the second pixel row and the first light emission control line is connected to the gate electrode of the second light emitting transistor of a plurality of pixels included in the second pixel row, wherein a plurality of pixels included in the third pixel row have the second wire connection shape, and wherein a plurality of pixels included in the fourth pixel row have the first wire connection shape.

9. The display device of claim 8, wherein the wire connection shape included in the first pixel row to the fourth pixel row is repeated by four pixel row units.

10. The display device of claim 8, wherein in the first field of one frame in response to the first light emission control signal transmitted through the first light emission control line, a plurality of pixels included in the first pixel row and the fourth pixel row respectively are configured to emit the light through the first element, and a plurality of pixels included in the second pixel row and the third pixel row are configured to emit the light through the second element.

11. The display device of claim 8, wherein in the second field of one frame in response to the second light emission control signal transmitted through the second light emission control line, a plurality of pixels included in the first pixel row and the fourth pixel row respectively are configured to emit the light through the other element, and a plurality of pixels included in the second pixel row and the third pixel row are configured to emit the light through one element.

12. The display device of claim 1, further comprising a light emission driver configured to sequentially supply a first light emission control signal controlling the light emitting of the first light emitting element in the first field included in one frame and a second light emission control signal controlling the light emitting of the second light emitting element in the second field included one frame to a plurality of the first light emission control lines and a plurality of the second light emission control lines connected to a plurality of pixels according to the pixel row.

13. The display device of claim 12, wherein the first and second light emission control signals have opposite voltage phases to each other, and wherein the voltage phases of the first light emission control signal and the second light emission control signal of the first field and the second field are inverted.

14. The display device of claim 1, wherein when the input data signal is a 1×1 dot pattern signal crossing and displaying a white image and a black image in up/down and right/left directions, color distribution ratios of the image displayed by the first field data signal and the image displayed by the second field data signal are substantially equal to each other.

15. The display device of claim 14, wherein the color distribution ratios comprise a distribution ratio of the color data signal of the highest luminance in the first field and the second field.

16. The display device of claim 15, wherein the color data signal of the highest luminance is a green data signal.

17. A method of arranging an image data memory of a display device including a plurality of pixels having at least two light emitting elements emitting light of different colors, driven with a first field and a second field for one frame, extracting an input data signal during one frame to apply to a data line, and controlling the light emitting of at least two light emitting elements for each field to be displayed, comprising;

dividing the input data signal into the first field data and the second field data;

arranging and storing the first and second field data according to a light emitting driving sequence; and transmitting the first and second field data signals to at least a group of pixels defined by four continuous pixel rows and three continuous pixel columns, wherein each of the first and second field data signals includes a color data signal pattern in which a first pair of pixels in each of the same pixel columns of the first and fourth pixel rows are configured to display the same color, and a second pair of pixels in each of the same pixel columns of the second and third pixel rows are configured to display the same color.

18. The method of claim 17, wherein the arranged first and second field data respectively include the color data signal pattern repeatedly.

19. The method of claim 17, wherein an arrangement sequence of the color emitted by two light emitting elements included in the pixels corresponding to the same pixel row is a sequence of a first color, a second color, and a third color.

20. The method of claim 19, wherein the first color is red, the second color is green, and the third color is blue.

21. The method of claim 17, wherein the first and second field data signals are crossed with different colors from each other.

22. The method of claim 21, wherein the first field data include i) the combination of a first color data signal, a third color data signal, and a second color data signal sequentially applied to three pixels included in the first pixel row and the fourth pixel row of the first region, and ii) the combination of the second color data signal, the first color data signal, and the third color data signal sequentially applied to three pixels included in the second pixel row and the third pixel row of the first region.

23. The method of claim 21, wherein the second field data include i) the combination of a second color data signal, a first color data signal, and a third color data signal sequentially applied to three pixels included in the first pixel row and the fourth pixel row of the first region, and ii) the combination of the first color data signal, the third color data signal, and the second color data signal sequentially applied to three pixels included in the second pixel row and the third pixel row of the first region.

24. The method of claim 17, wherein when the input data signal is a 1×1 dot pattern signal crossing and displaying a white image and a black image in up/down and right/left directions, color distribution ratios of the image displayed by the first field data signal and the second field data signal are equal.

25. The method of claim 24, wherein the color distribution ratios comprise a distribution ratio of the color data signal of the highest luminance in the first field and the second field.

26. The method of claim 25, wherein the color data signal of the highest luminance is a green data signal.

* * * * *